US006582272B1

(12) United States Patent
Nelson et al.

(10) Patent No.: US 6,582,272 B1
(45) Date of Patent: Jun. 24, 2003

(54) BALLOON WEIGHT AND RIBBON ASSEMBLY

(75) Inventors: David C. Nelson, Akron, OH (US); John J. Andrisin, Cuyahoga Falls, OH (US); Brent G. Anderson, Barrington, IL (US)

(73) Assignee: Premium Balloon Accessories, Inc., Sharon Center, OH (US)

( * ) Notice: Subject to any disclaimer, the term of this patent is extended or adjusted under 35 U.S.C. 154(b) by 0 days.

(21) Appl. No.: 09/687,307

(22) Filed: Oct. 13, 2000

(51) Int. Cl.[7] ..... A63H 3/06
(52) U.S. Cl. ..... 446/220
(58) Field of Search ..... 446/220, 221, 446/222, 223, 224, 225, 226, 186; 40/212, 214; 248/346, 346.01, 910

(56) References Cited

U.S. PATENT DOCUMENTS 4,013,035 A * 3/1977 Kopeika ..... 116/124 B
5,024,011 A * 6/1991 Collins ..... 40/124.1
5,074,510 A * 12/1991 Metz ..... 248/176
5,378,186 A * 1/1995 Becker ..... 446/220
5,743,389 A * 4/1998 Cutler et al. ..... 206/194
5,755,419 A * 5/1998 Gearhart et al. ..... 248/346.01
D401,255 S * 11/1998 Burns ..... D15/199
5,989,093 A * 11/1999 Nelson et al. ..... 446/220
6,076,758 A * 6/2000 Kieves et al. ..... 242/400
6,238,259 B1 * 5/2001 Medina ..... 446/71
6,276,984 B1 * 8/2001 Komaba ..... 446/223

* cited by examiner

*Primary Examiner*—Jacob K. Ackun
*Assistant Examiner*—Faye Francis
(74) *Attorney, Agent, or Firm*—Renner, Kenner, Greive, Bobak, Taylor & Weber

(57) ABSTRACT

A balloon weight and ribbon assembly includes a spool having a length of ribbon wound thereabout, the ribbon being secured at one end to the spool and at the other end to a lightweight breakaway tab which initially comprises a part and parcel of the spool. A slot in the tab accommodates receipt of a double knot at one end of the ribbon, while a slot in the spool accommodates receipt of a double knot of the ribbon at the opposite end. A piece of double backed adhesive tape is provided on the breakaway tab to allow for securement of the tab to the neck or tail of an inflated balloon.

14 Claims, 2 Drawing Sheets

BALLOON WEIGHT AND RIBBON ASSEMBLY

TECHNICAL FIELD

The invention herein resides in the art of balloon devices and accessories. More particularly, the invention relates to a balloon weight adapted to be tethered to an inflated balloon in restraint thereof. In part, the invention relates to a balloon weight capable of selectively releasing a desired length of ribbon and having an attachment mechanism that does not unduly weight the balloon down. Specifically, that portion of the invention relates to a balloon weight and ribbon assembly in which the balloon weight comprises a spool receiving the ribbon and having a lightweight break-away tab connected thereto which is adapted for connection to the balloon, the ribbon being interconnected between the tab and the weight spool and selectively retained in a slot formed in the balloon weight.

BACKGROUND ART

The use of balloons as a "favor" or at parties, celebrations, and other events is now extremely well known. Millions of balloons are so used each year. Generally such balloons are attached to either a stick and a cup or a ribbon so that they can be restrained by the user. Additionally, the balloons are typically filled with helium gas to provide a "lift", allowing them to stay aloft at the end of the tethered ribbon. Of particular concern of many localities is assurances that such inflated balloons are restrained from free flight into electrical power lines and transformers as well as the atmosphere. Particular concern exists with respect to Mylar or metallic balloons, which pose a threat to electrical transmission wires, and which are not biodegradable. Many municipalities and other governmental agencies consider such balloons to pose at least some threat to the environment. Accordingly, many governmental agencies require that such metallic balloons be tethered to a weight, with the weight being sufficient to prevent the balloon from free flight into the atmosphere.

It has previously been known to employ a weight at the end of a ribbon tethered to a balloon, to restrain the balloon from free flight. Most often, there is a necessity for the retail clerk to cut a length of ribbon, attach one end of it to the weight, and to knot or otherwise attach the opposite end to the balloon. The operation is extremely time consuming, and occasionally ineffective. To hasten the operation by the retail clerk, some balloon weights have been provided with a pre-attached length of ribbon, such that the retail clerk need only attach the opposite end to the balloon. At least one known design employs a spool for windably storing the ribbon. Once the ribbon is secured to the balloon, the ribbon unravels from the spool as the balloon travels aloft. Without restraint, the balloon will unwind the entire length of ribbon. To control the height of the balloon, the length of ribbon is cut. Often, balloons are used to make balloon bouquets using several balloons suspended at differing heights. To achieve this effect, a different length ribbon must be cut for each height. As can be appreciated, this process is quite labor intensive.

It is known to attach the ribbon of such balloon weights with a solid tab frangible from the balloon weight. The tab is commonly attached to a balloon with adhesive or tape. While the frangible tab suitably attaches the ribbon to the balloon, its size and solid construction may unduly weight the balloon, preventing the balloon from reaching its desired height and causing the ribbon to sag. This problem is exacerbated by underinflated balloons or balloons that have lost their original lift, as from leakage.

These tabs are of further concern because of their small size. The size and coloration of these tabs make them attractive to children. A child, therefore, may place the tab in his or her mouth, where it could become lodged in the child's airway. A properly sized tab should prevent the child from swallowing the tab, but a solid tab can still restrict or cut off the airflow to the child's lungs.

DISCLOSURE OF INVENTION

In light of the foregoing, it is an aspect of the instant invention to provide a balloon weight and ribbon assembly having a lightweight frangible tab for securing the balloon weight ribbon to the balloon.

Another aspect of the invention is to provide such a balloon weight and ribbon assembly with a tab that will not block a child's airway.

A further aspect of the invention is to provide such a balloon weight and ribbon assembly in which the frangible tab has a perforated or lattice construction.

An additional aspect of the invention is to provide, in a balloon weight and ribbon assembly, a ribbon retaining assembly for selectively restricting the amount of ribbon unwound from the balloon weight and ribbon assembly.

Yet another aspect of the invention is to provide such a balloon weight having a ribbon retaining slot adapted to selectively retain and release a ribbon.

The foregoing and other aspects of the invention which will become apparent as the detailed description proceeds are achieved by a balloon weight, attached to a balloon by a tether, including a receptacle adapted to carry the tether and a tether restraint carried by said receptacle.

DESCRIPTION OF THE DRAWINGS

For a complete understanding of the objects, techniques, and structure of the invention reference should be made to the following detailed description and accompanying drawings wherein.

BEST MODE FOR CARRYING OUT THE INVENTION

Figure 1:
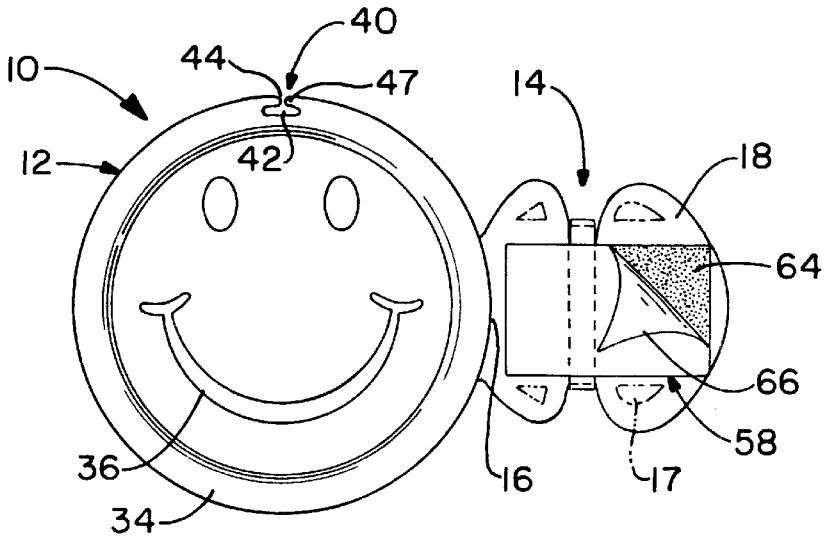
FIG. 1 is a top plan view of the balloon weight and ribbon assembly according to the invention.
Figure 2:
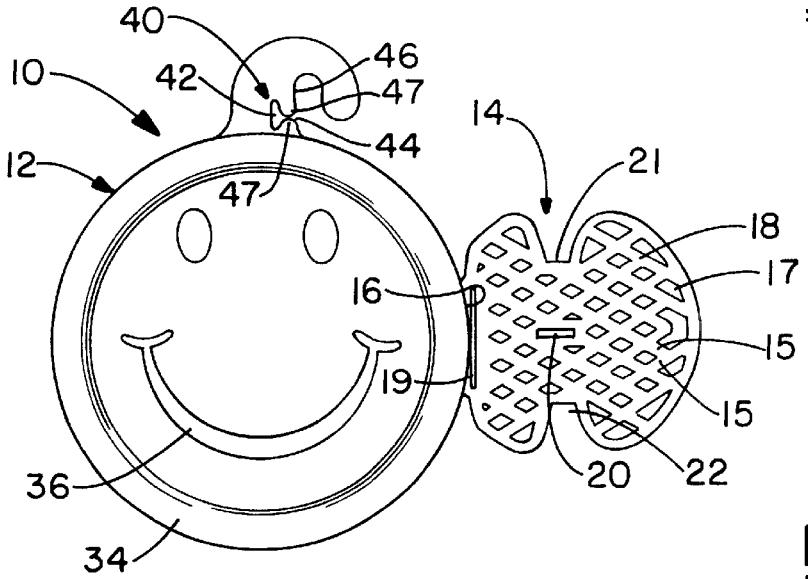
FIG. 2 is an edge elevational view of the balloon weight of FIG. 1.
Figure 3:
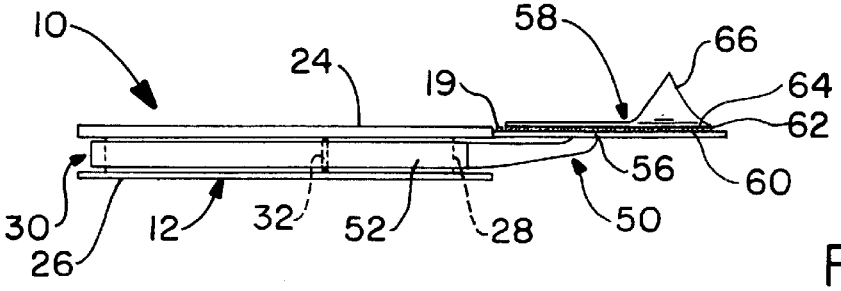
FIG. 3 is an edge elevational view of a balloon weight and ribbon assembly according to the invention.

With reference now to the drawings, and more particularly FIGS. 1–3, it can be seen that a balloon weight made in accordance with the invention is designated generally by the numeral 10. The balloon weight 10 includes a body portion 12 which, as will become apparent herein, is configured as a spool. Attached to the body portion 12 is a securement member, for example, a tab 14. A score line 16 continues the circumference of body portion 12 and comprises a weakened line of depression, allowing for the tab 14 to be easily broken from the body portion 12. It will be appreciated that the balloon weight 10 is preferably molded of plastic and, accordingly, the score line 16 provides a reliable means for allowing the tab 14 to be broken away from the body portion 12.

It will be particularly noted that the tab 14 is characterized by a generally perforated tab body 18 which may be constructed of a latticework of cross members 15 (FIG. 2) defining holes or perforations 17 therebetween. A portion of body 18 near score line 16 is reinforced to prevent the body 18 from fracturing when attempting to remove tab 14 from body portion 12. As can be readily appreciated, tab body 18 may be reinforced in known manner, including adding material near this juncture or filling the lattice perforations 17, as shown. Tab 14 may further include a locating ridge 19 for aligning the adhesive and release layer during manufacture and assembly of the balloon weight 10. Preferably, ridge 19 is located proximate the periphery of tab 14 and, more preferably, adjacent score-line 16 on the tab body. Tab body 18 is further provided with a slot 20 extending therethrough. Slot 20 may generally be centrally located and may be sized to receive a ribbon or other tether. Slot 20 may be of any shape and is preferably sized to retain a knotted end of the ribbon. It will be appreciated, however, that the ribbon end may be secured by adhesive or tape without the use of a knot. Consequently, slot 20 may be of nearly any size as long as it will receive the ribbon. Notches 21, 22 may be formed in the periphery of tab 14 for neatly wrapping the ribbon therebetween these notches 21, 22 are preferably coaxial and aligned with the notch 20 to facilitate wrapping of the ribbon by an automated process. Notches 21, 22 generally hold the ribbon layers in lateral alignment facilitating easy winding of the ribbon in an aesthetically pleasing manner.

It will further be noted that the periphery of tab 14 is characterized by angled corner pieces which are provided to assure that when the tab 14 is broken away from the body portion 12, sharp edges are exposed. Accordingly, the angled corner pieces are defined by being angled inwardly toward a tangent of the circumference of the body portion 12. In a preferred embodiment of the invention, the angled corner pieces from an angle of 30°–60° with the side edges of the tab 14, and in the preferred embodiment, the angle is 45° therewith. It is further contemplated that the corner pieces could be fully radiused to achieve this result.

While tab 14 may be of almost any size or shape, it is preferably sized to prevent the tab 14 from being swallowed by an infant. In the unfortunate event that tab 14 would become lodged in the infant's airway, the perforations 17 provide for the passage of air.

Figure 4:
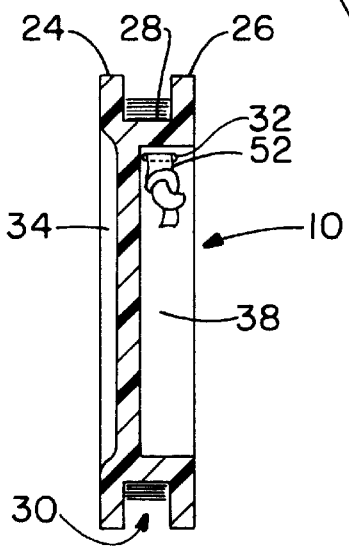
FIG. 4 is a cross sectional view of the balloon weight of FIG. 1, taken along the line 4—4.

As shown in FIGS. 2–4, the body portion 12 includes a top disk 24, from which tab 14 extends with the demarkation of the score line 16. Spaced below and parallel with the top disk 24 is a bottom ring 26. A cylindrical wall 28 is interposed between the top disk 24 and bottom ring 26. The area between the top disk 24, bottom ring 26, and cylindrical wall 28 defines an annular cavity 30 adapted to receive a wound length of ribbon. It will be appreciated that the elements 24–28 generally define a spool for that purpose.

It will further be appreciated that a slot 32 is provided in the cylindrical wall 28. The slot 32 passes through the wall 28 and into a cylindrical cavity 38. The slot 32 provides a means for receiving and retaining one end of a ribbon, as will be discussed below. It will further be noted that the top disk 24 may have a dish-shaped top surface 34, as illustrated. Moreover, decorative features, shown in phantom at 36, may be molded into or otherwise carried by the dish-shaped surface 34 of the top disk 24.

The top disk 24 may be further provided with a ribbon restraining assembly 40. The restraining assembly 40 may be characterized by a ribbon-receiving aperture 42 having an opening 44 providing ribbon entry to aperture 42. Opening 44 may be sized smaller than aperture 42 to restrict egress of the ribbon as will be described below. Ribbon restraining assembly 40 is preferably located near the circumference of body 12 to ease insertion of the ribbon. As will be appreciated, restraining assembly 40 may be located at any point on body 12 or multiple restraining assemblies may be used. Alternatively, restraining assembly 40 may placed outside of body 12 on an external member. The external member, for example, a hook 45 may be carried on or integrally formed with body 12 to facilitate display of the balloon weight 10. As shown in FIG. 2, this hook 45 may carry restraining assembly 40.

With reference to FIG. 2, aperture 42 is shown as being formed substantially proximate to the inner side 46 of hook 45 and opening 44 is located generally off-center with respect to the aperture 42. In this regard, the restraining assembly may be characterized as a generally L-shaped or T-shaped slot. Preferably, the corners 47 of the members defining the aperture 42 and opening 44 are rounded over to ease entry of the ribbon and reduce the likelihood of fraying or tearing.

With reference now to FIG. 3, it can be seen that a balloon weight and ribbon assembly according to the invention is designated generally by the numeral 50. Here, the balloon weight 10 has been provided with a precut length of ribbon 52 wound about the spool defined between the top disk 24, bottom ring 26, and cylindrical wall 28.

The ribbon 52 is passed through the slot 32 and double knotted within the cylindrical cavity 38, thus securing it to the weight 10. The spool of the balloon weight 10 may then be appropriately mounted to a suitable automatic winding machine, in which a predetermined length, such as 6 feet of ribbon may be wound around the spool. The opposite end of the length of ribbon 52 is then passed through the slot 20 of tab 14 and double knotted on the top side thereof, or otherwise secured as by adhesive or tape, thus securing it to the tab 14.

With the ribbon double knotted in the cylindrical cavity 38 at one end thereof, wrapped about the spool of the weight 10, and double knotted on the tab 14 at the opposite end thereof, a single unitary tethered weight assembly is defined. To provide a means for securing the weight to a balloon, a piece of double backed tape 58 is provided. While the double backed tape may take any of various configurations, according to one embodiment of the invention, a piece substantially equal in size to tab 14 is attached to the top surface of the tab 14, and over the double knotted end 56 of ribbon 52. A first adhesive layer 60 makes such engagement. According to one embodiment of the invention, the double backed tape may include a foam layer 62 over which a second adhesive layer 64 is laid. A release liner 66 is placed over the adhesive layer 64, and is adapted for removal to expose the adhesive layer 64 when desired. The commencement of such removal is shown in FIG. 3. As previously discussed, the release liner 66 and adhesive 64 may be located or aligned by ridge 19 on tab 14. It is contemplated that other means might be employed to secure the tab 14 and associated ribbon 52 to the neck or tail of the balloon, such as any suitable adhesive, sonic welding or heat staking.

The assembly as shown in FIG. 3 may be stocked by a retail outlet for employment with a balloon upon request. The hook 45 provides for such stocking on a horizontal rod or the like. When a balloon is requested by a customer, the balloon is simply inflated and sealed at the neck or tail thereof as by a self sealing valve or the like. The release liner 66 is then removed from the double backed tape 58, exposing the adhesive layer 64. The adhesive layer 64 is then secured to the neck or tail of the balloon such that the balloon now includes the tethered weight assembly. At the point of sale, before or after attachment of the adhesive layer 64 to the balloon, the tab 14 may be broken from the body portion 12 by simply flexing the tab about the score line or fracture line 16. In some instances, the customer may simply request that the tab 14 be left intact, to be separated from the body portion 12 when the balloon arrives at home or its final destination. In other instances, the tab 14 may be broken away at the point of sale.

Figure 5:
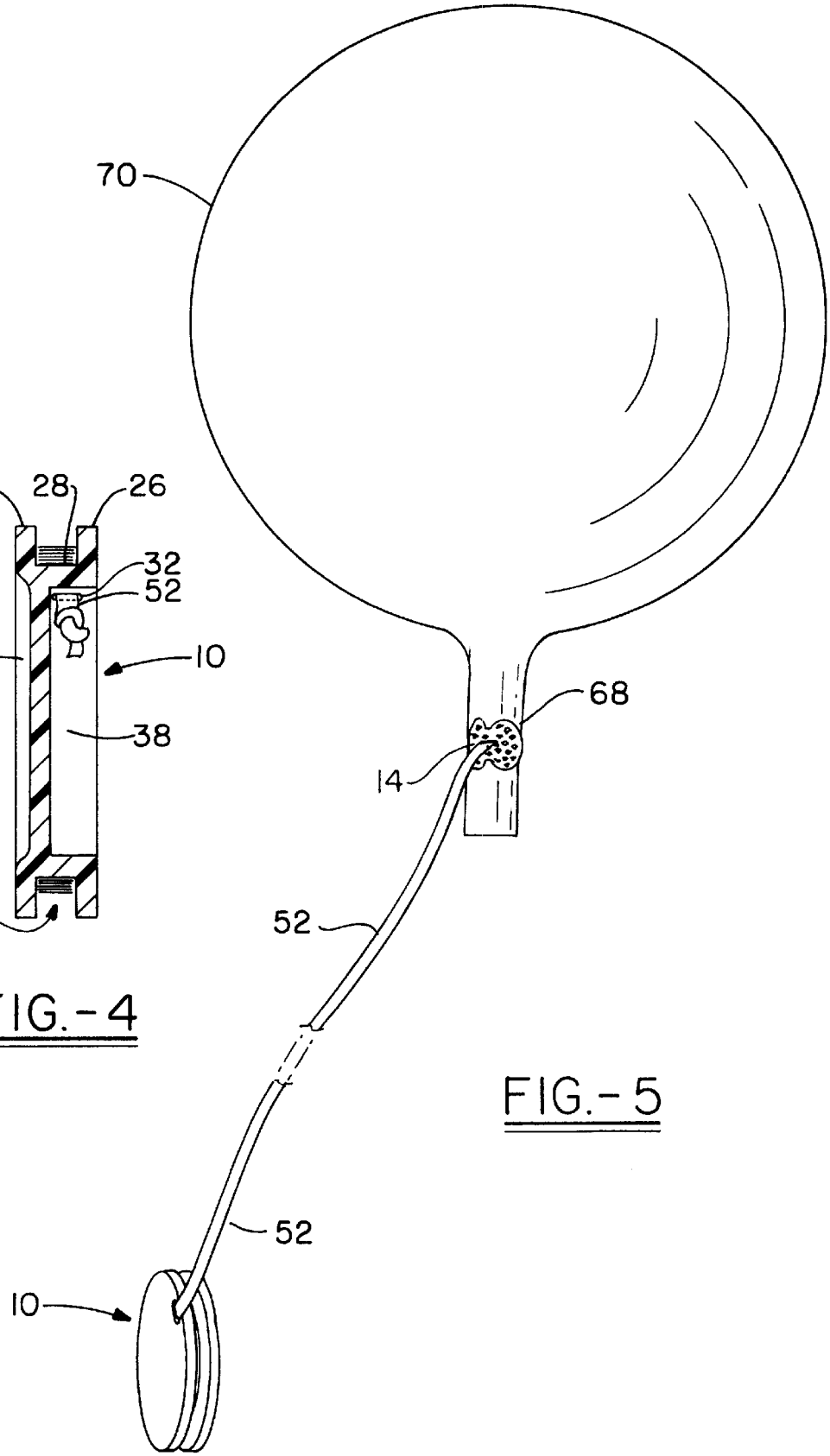
FIG. 5 is an illustrative view of the balloon weight and ribbon assembly of the invention, employed with a balloon attached.

As shown in FIG. 5, the balloon weight 10 is tethered by a length of ribbon 52 to an inflated balloon 70. The sealed tail or neck 68 of the balloon 70 receives the tab 14 of the balloon weight assembly 10 as through adhesive attachment by double backed tape 58, as illustrated. With the weight 10 being of sufficient mass to overload the lift of the inflated balloon 70, it is assured that the balloon 70 will remain tethered to the weight 10, and prevented from free flight into the atmosphere or power lines.

The balloon weight and ribbon assembly presented herein assures that the end of the ribbon to be attached to the balloon is always oriented in the same location—attached to the breakaway tab. Moreover, the balloon weight and ribbon assembly constitutes a totally self contained unit, with the weight, ribbon, and balloon attachment means all contained in a unitary piece.

It should now be appreciated that the balloon weight and ribbon assembly disclosed herein provides a single unitary easy-to-use assembly which allows for securement of a tethered balloon to a weight. The balloon weight and ribbon assembly is easily manufactured and is given to automation in spool winding. The double knotted attachment of the ribbon to both the spool and the tab assures that the balloon will not break away from the weight, while the double backed adhesive tape or other securement means assures that the retail clerk can effect secured engagement of the balloon weight to the balloon at the point of sale. The clerk can easily adjust the height of the balloon by unwinding a length of ribbon and securing it within the ribbon-retaining slot 42, 44. If another length is later desired, one can adjust the length by releasing the ribbon and winding or unwinding the ribbon, as necessary. Thus, users avoid having to cut and re-cut the ribbon to vary the length of ribbon selected. Finally, the lightweight tab, achieved by the holes 17 of the waffle designs, reduces the likelihood of the balloon failing to float.

Thus it can be seen that at least one of the objects of the invention have been satisfied by the structure presented above. While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A balloon weight attached to a balloon by a tether, comprising:

a body portion adapted to carry the tether;

a tether restraint including a tether receiving slot and a opening communicating externally of said slot adapted to selectively receive and release the tether the opening being sized smaller than the tether, such that, the tether is compressed to pass through said opening and expands into said slot; wherein said tether restraint is formed on an external member extending outwardly from and integrally formed with said body portion, wherein said external member is a hook and said receiving slot is formed adjacent an inner side of said hook.

2. The balloon weight of claim 1, wherein said tether receiving slot communicates externally of said body portion via an opening.

3. The balloon weight of claim 2, wherein said opening is sized smaller than said slot.

4. The balloon weight of claim 1, further comprising a frangible tab extending from said body portion, said tab adapted to receive an end of the tether and secure said end to a balloon.

5. A balloon weight assembly attached to a balloon, comprising:

a body portion carrying a tether; and a securement member carried by said body portion attachable to the balloon, wherein said securement member is perforated by a series of holes substantially covering said securement member, wherein an end of said tether extends from said body portion and attaches to said securement member.

6. The balloon weight assembly of claim 5, wherein said securement member is detachable from said body portion.

7. The balloon weight assembly of claim 5, wherein said securement member comprises a tab.

8. The balloon weight assembly of claim 7, wherein said perforated tab includes a plurality of spaced members defining openings therebetween.

9. The balloon weight assembly of claim 8, wherein said spaced members are configured as a lattice.

10. The balloon weight of assembly of claim 7, wherein said tab defines a slit for receiving said tether.

11. The balloon weight assembly of claim 7, further comprising a pair of opposed notches formed in a periphery of said tab.

12. The balloon weight assembly of claim 5, further comprising a locating ridge carried on a surface of said securement member.

13. The balloon weight assembly of claim 12, wherein said locating ridge is adjacent said body portion.

14. A balloon weight comprising:

a body adapted to windingly receive a tether;

said tether being attached to said body at one end;

a securement member carried on said body and selectively detachable therefrom, wherein another end of said tether is attached to said securement member;

said securement member being attachable to a balloon to tether said balloon to said body;

a tether restraint adapted to adjust a length of tether extending between said body and said securement member, said tether restraint including a slot and opening defined by an external member extending outward from said body, wherein said opening extends laterally outward from said slot allowing said tether to be selectively slid into said slot through said opening, and wherein said opening is sized smaller than said slot to retard egress of said tether from said slot.

* * * * *